United States Patent [19]

Morrell, Jr.

[11] Patent Number: 4,524,896

[45] Date of Patent: Jun. 25, 1985

[54] REVERSIBLE STAPLE FEEDER SHOE AND DOOR SYSTEM FOR THE MAGAZINE OF A STAPLE DRIVING TOOL

[75] Inventor: Robert F. Morrell, Jr., Cincinnati, Ohio

[73] Assignee: Senco Products, Inc., Cincinnati, Ohio

[21] Appl. No.: 546,927

[22] Filed: Oct. 31, 1983

[51] Int. Cl.[3] ..... B25C 5/02; B25C 5/06; B27F 7/00

[52] U.S. Cl. ..... 227/126; 227/109; 227/120; 227/125; 227/127; 227/128; 227/156

[58] Field of Search ..... 227/109, 120, 125, 126, 227/127, 128, 156

[56] References Cited

U.S. PATENT DOCUMENTS

| | | | |
|---|---|---|---|
| 2,227,826 | 1/1941 | Drypolcher et al. | 227/127 X |
| 3,022,509 | 2/1962 | De Man | 227/109 |
| 3,042,925 | 7/1962 | Frostad et al. | 227/128 |

*Primary Examiner*—Paul A. Bell
*Assistant Examiner*—Taylor J. Ross
*Attorney, Agent, or Firm*—Frost & Jacobs

[57] ABSTRACT

A reversible feeder shoe and door system for the magazine of a staple driving tool enabling set-up of the tool for right or left handed loading. The tool magazine comprises an elongated rail terminating at its forward end at the guide body of the tool. A row of staples is slidably mounted in straddling fashion on the rail. A feeder shoe, having a substantially symmetrical inverted U-shaped body, is slidably mounted on the rail in straddling fashion behind the row of staples. A resilient member constantly urges the feeder shoe forwardly so that the forwardmost staple of the row is located in the guide body drive track. The magazine may include a U-shaped elongated body in which the track is mounted. An elongated door is provided, swingable between an open position exposing the rail top and a closed position overlying the rail top to prevent inadvertent dislodgement of the staples from the rail. The feeder shoe has an operating handle extending laterally from one of its sides and a lug extending laterally from the other of its sides. When the shoe is shifted to its rearwardmost position on the rail by the operating handle, the lug engages a portion of the door, opening the door and releasibly locking the door in its open position, the feeder shoe being also releasibly locked in its rearwardmost position for loading. The feeder shoe is reversible on the rail so that its operating handle can be grasped by the left or right hand of the operator. The door is reversible, being mountable in parallel spaced relationship to either side of the rail.

8 Claims, 12 Drawing Figures

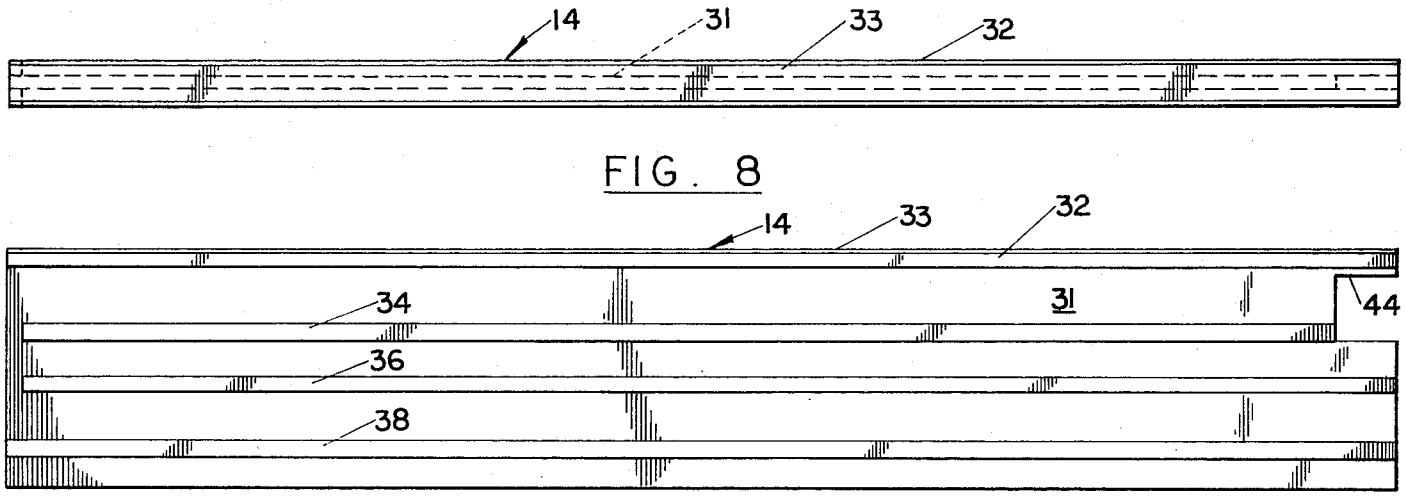
FIG. 8
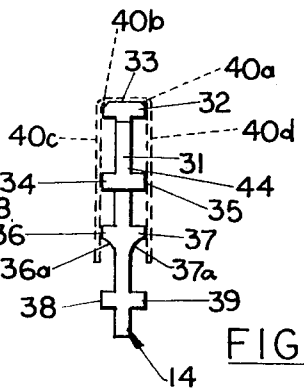
FIG. 10
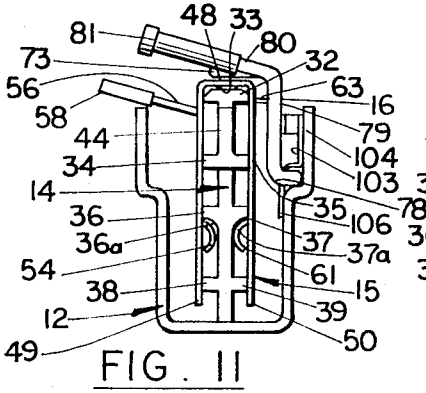
FIG. 9
FIG. 11
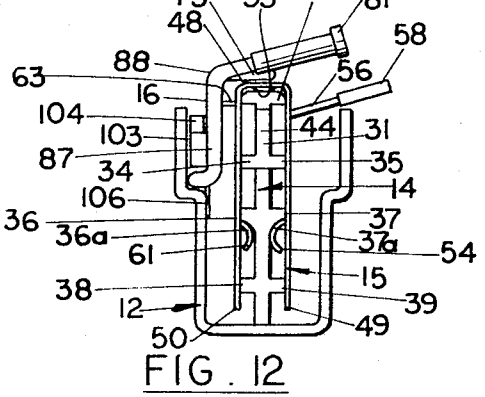
FIG. 12

REVERSIBLE STAPLE FEEDER SHOE AND DOOR SYSTEM FOR THE MAGAZINE OF A STAPLE DRIVING TOOL

TECHNICAL FIELD

The invention relates to a staple feeder shoe and door system for the magazine of a staple driving tool, and more particularly to such a system wherein the staple feeder shoe and door are reversible enabling quick and easy set-up of the tool for right or left-handed loading.

BACKGROUND ART

While the teachings of the present invention may be applicable to the magazine of many types of home and industrial fastener driving tools, for purposes of an exemplary illustration, the invention will be described in its application to an industrial staple driving tool.

Prior art workers have devised numerous staple driving tools and magazines therefor. In many types of jobs, it is imperative that the staple driving tool operator be able to reload staples into the tool magazine easily, quickly and efficiently. This is so that there will be little or no time lost in a piecework operation, or that staple drivings will not be missed in an assembly line operation.

There are many types of staple driving tool magazines requiring different loading procedures and manipulations. Top loading magazines, bottom loading magazines and end loading magazines are all well known in the art. In general, these three types of magazines can be loaded by left-handed and right-handed operators with equal facility.

The so-called top-side loading magazine, on the other hand, is generally designed or set-up for right-handed loading and is difficult and awkward for a left-handed operator to load. The top-side loading magazine generally comprises an elongated rail straddled by a row or stick of staples and a feeder shoe located behind the staples. A resilient member is provided to constantly urge the feeder shoe, and thus the row of staples, forwardly so that the forwardmost staple of the row is located in the drive track of the tool guide body, ready to be driven. An elongated door is provided, which is swingable between an open position and a closed position wherein the door at least partially overlies the top surface of the rail, assuring that the row of staples mounted thereon cannot fall off of or become dislodged from the rail when the tool is used other than in a substantially upright position. To reload this sort of magazine, it is necessary to pull the feeder shoe to its rearwardmost position, open the door and insert the staples inwardly and downwardly over the rail from one side of the tool. When a magazine of this sort is designed for a right-handed person and is manipulated by a right-handed person, it can be quickly and easily refilled with staples. However, this same magazine would be difficult and awkward to load by a left-handed operator. The only alternative would be to provided the magazine in both left-handed and right-handed models.

The present invention is based upon the discovery that if a top-side loading magazine is provided with a reversible door and a reversible shoe, the staple driving tool can be quickly and easily set-up for use by a left-handed or right-handed operator, utilizing a minimum of parts and without the necessity of having left-handed and right-handed models or specific left-handed and right-handed parts.

DISCLOSURE OF THE INVENTION

According to the invention, there is provided a reversible feeder shoe and door system for the magazine of a staple driving tool, which enables the tool to be set-up for right or left-handed loading.

The tool magazine comprises an elongated rail. The rail terminates at its foward end at the guide body of the tool. A row or stick of staples is slidably mounted in straddling fashion on the rail with the staple crown portions being supported by the top surface of the rail and the staple legs extending downwardly on either side of the rail. A feeder shoe, having a substantially symmetrical, inverted U-shaped body, is slidably mounted on the rail in straddling fashion behind the row or stick of staples. A resilient member constantly urges the feeder shoe forwardly on the rail, so that the forwardmost staple of the row or stick is located in the guide body drive track.

While not required, the magazine may include a U-shaped elongated body in which the rail is mounted. The elongated magazine body is mounted at its forward end to the guide body and is mounted at its rearward end to a portion of the tool body.

An elongated door extends substantially the length of the magazine and is swingable between an open position exposing the top of the rail and a closed position overlying the top of the rail to prevent inadvertent dislodgement of the staples from the rail when the tool is used other than in an upright position.

The feeder shoe has an operating handle extending laterally from one side thereof. The operating handle may be provided with a cap for ease of grasping. The feeder shoe has a lug extending laterally from the side opposite the operating handle side. When the shoe is manually shifted to its rearwardmost position on the rail through the use of the operating handle, the feeder shoe lug engages a portion of the door, shifting the door to and releasably locking the door in its open position, while at the same time locking the feeder shoe in its rearwardmost position for loading.

The feeder shoe is reversible on the rail so that its operating handle can be grasped by the left hand or the right hand of the operator. The door is reversible, being mountable in parallel-shaced relationship with either side of the rail.

BRIEF DESCRIPTION OF THE DRAWINGS

FIG. 8 is a plan view of the rail of the present invention.

FIG. 9 is a side elevational view of the rail of FIG. 8.

FIG. 10 is an end elevational view of the rail of FIG. 8.

FIGS. 11 and 12 are end elevational views of the magazine with its end cap removed, illustrating the feeder shoe and door in left and right-handed configurations, respectively.

DETAILED DESCRIPTION OF THE INVENTION

Figure 1:
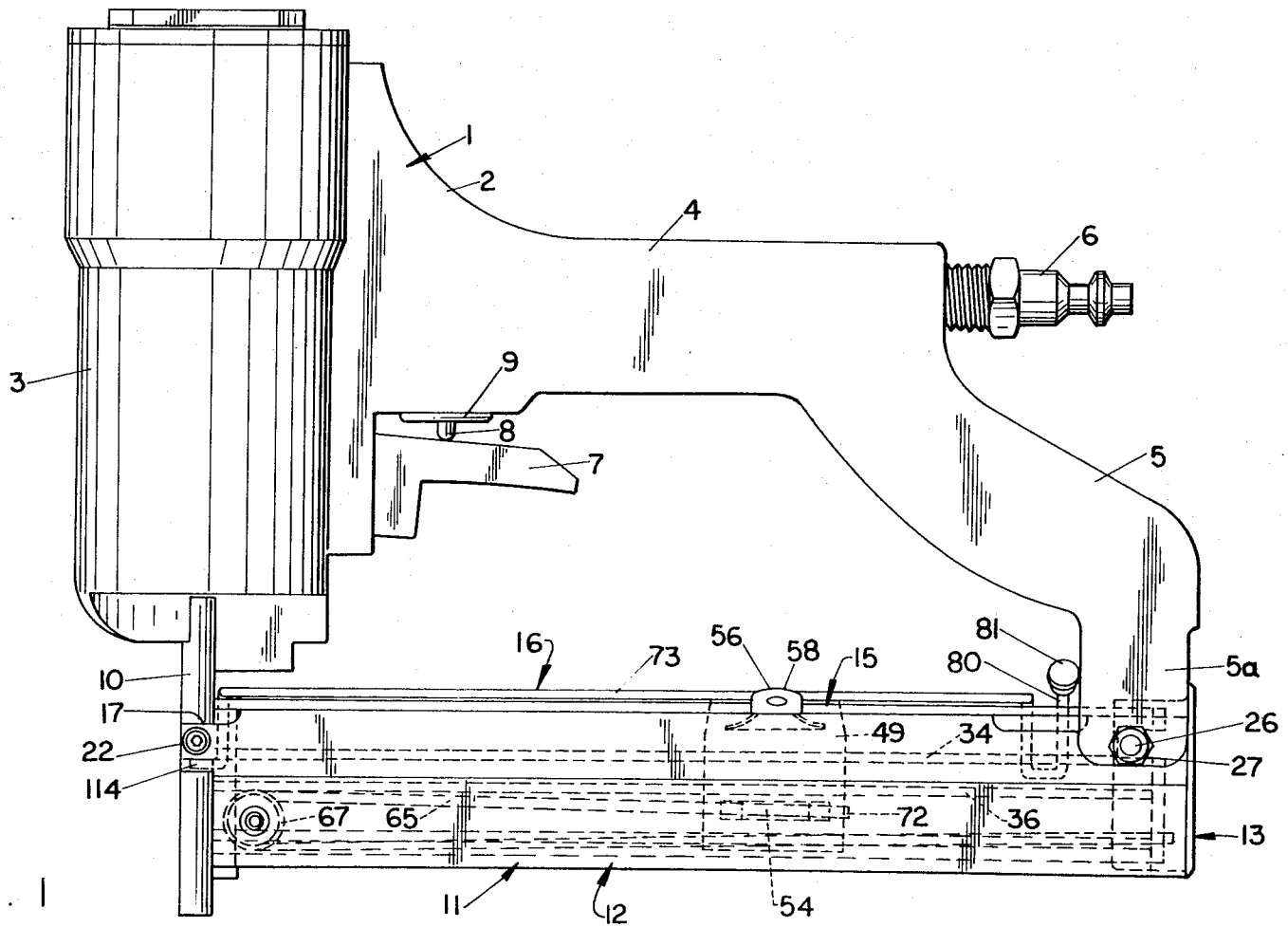
FIG. 1 is a side elevational view of an exemplary industrial staple driving tool having a magazine provided with the reversible shoe and door system of the present invention.

FIG. 1 illustrates an exemplary industrial staple driving tool provided with a magazine having a reversible door and feeder shoe system in accordance with the present invention. It will be understood by one skilled in the art that the nature of the staple driving tool does not constitute a limitation on the present invention. The teachings herein are applicable to many types of fastener driving tools.

The staple driving tool is generally indicated at 1 and has a body 2 with a main cylinder portion 3, a handle portion 4 and a rearward portion 5. The tool 1 is illustrated as being of the fluid actuated type, having a fitting 6 for connection to a source of compressed air or the like. The main cylinder portion 3 of body 2 contains the main cylinder surmounted by the main valve and containing a piston-actuated driver (none of these elements being shown). A manual trigger 7 actuates the stem 8 of a remote valve 9, which in turn controls the main valve.

A guide body 10 contains the driver track (not shown). A staple is located in the driver track and the staple driver, when the tool is actuated, shifts downwardly in the driver track with great force, driving the staple into a workpiece. While an air-actuated tool is shown at 1, the tool could be of the electro-mechanical type, wherein the driver is driven by a solenoid, one or more flywheels, or the like.

Figure 2:
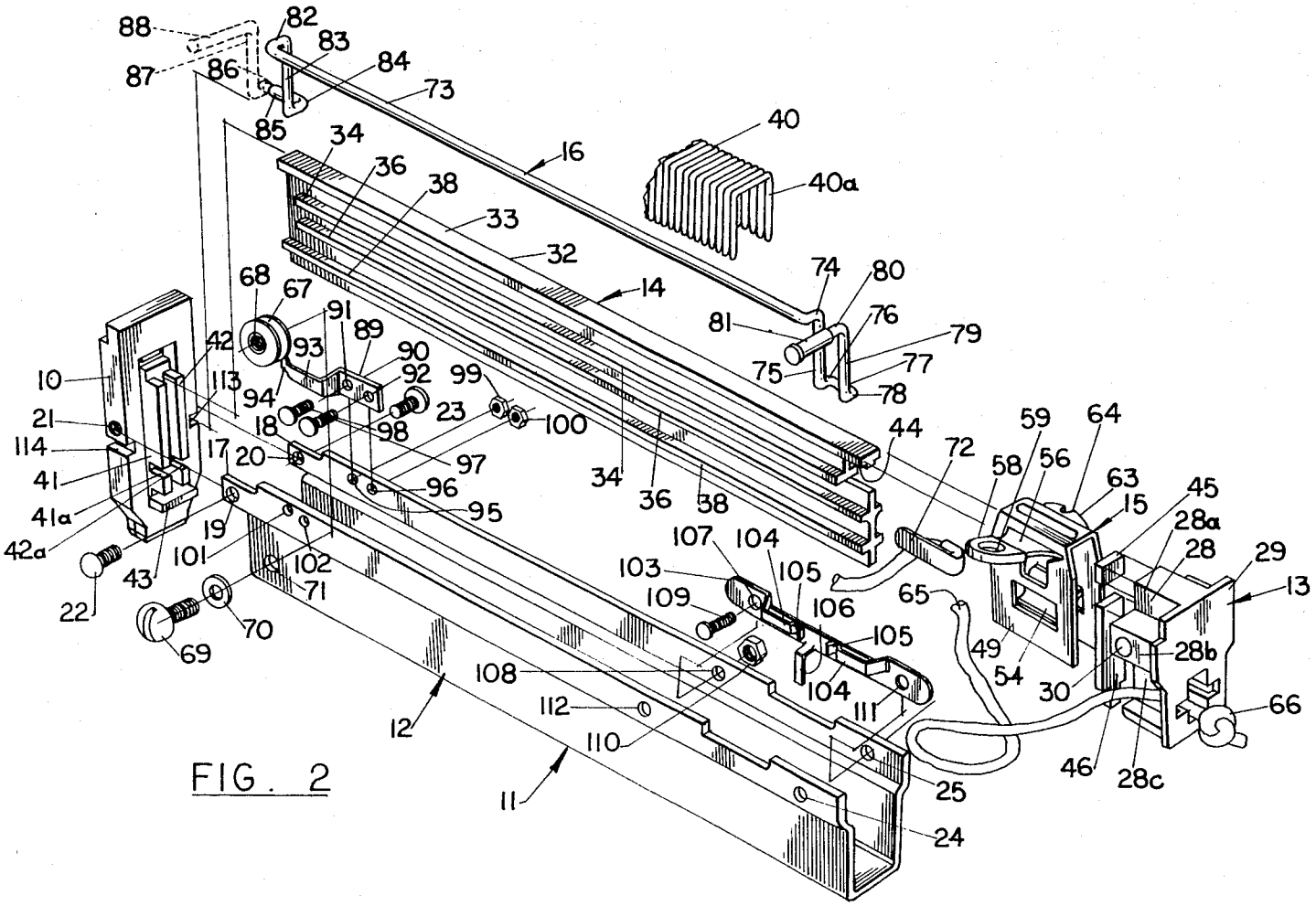
FIG. 2 is an exploded perspective view of the magazine of FIG. 1, illustrating the various parts thereof, and including the tool guide body.
Figure 6:
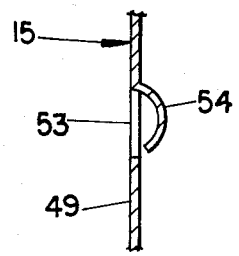
FIG. 6 is a fragmentary cross-sectional view taken along section line 6—6 of FIG. 5.
Figure 3:
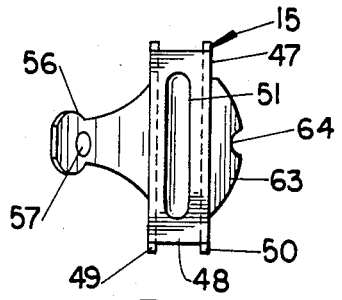
FIGS. 3, 4 and 5 are, respectively, plan, end and side elevational views of the feeder shoe of the present invention.
Figure 5:
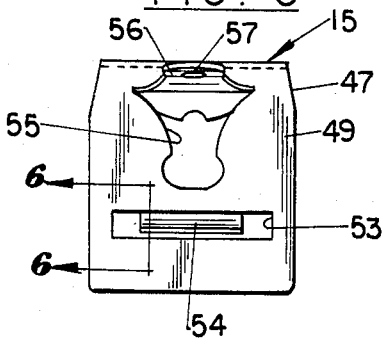
Figure 4:
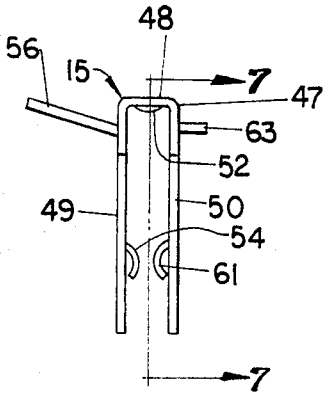
Figure 7:
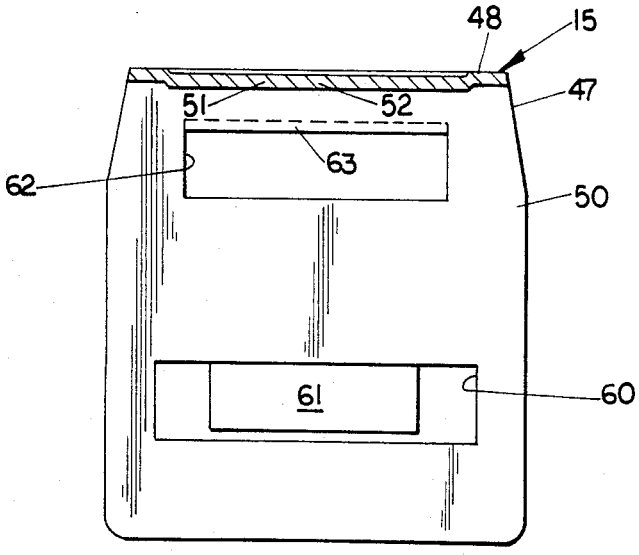
FIG. 7 is a cross-sectional view taken along section line 7—7 of FIG. 4.

Reference is now made to FIGS. 1 and 2. In these Figures, the magazine is generally indicated at 11. The basic components of the magazine 11 comprise a body generally indicated at 12, an end cap for the body generally indicated at 13, a rail generally indicated at 14, a feeder shoe generally indicated at 15, and a door generally indicated at 16. The remaining parts of the magazine will be described in their turn.

The magazine body 12 comprises an elongated member of U-shaped cross-sectional configuration. The body 12 is preferably made of metal, but could be extruded or molded of plastic or the like.

At its forward end, the body 12 has a pair of extensions 17 and 18, provided with coaxial perforations 19 and 20, respectively. The extensions are adapted to lie to either side of the tool guide body 10. The tool guide body 10 has a threaded perforation on each side, corresponding to body perforations 19 and 20. One of the guide body perforations is shown at 21. The magazine body 12 is affixed to the guide body by means of a screw 22 passing through magazine body perforation 19 and into the threaded perforation 21 of guide body 10. A similar screw 23 passes through magazine body perforation 20 and into the other threaded perforation (not shown) of guide body 10. When fastened in place, the forward end of the magazine body 12 abuts the rearwardly facing surface of guide body 10.

At its rear end, the magazine body has a pair of coaxial perforations 24 and 25. The rearward portion 5 of tool body 2 has an extension **5*a* which lies to one side of magazine body 12 (see FIG. 1). A bolt 26 passes through a perforation in body extension 5*a* and through the coaxial perforations 24 and 25 of the magazine body 12 to complete the mounting of the magazine body 12 to the tool 1. Bolt 26 is provided with a nut 27**.

As is evident from FIGS. 1 and 2, the forward end of magazine body 12 is closed by the tool guide body 10. The rearward end of the magazine body 12 is closed by the end cap 13. The end cap 13 has a body portion 28 receivable within the rearward end of magazine body 12, and a rear wall portion 29 which abuts the rearward end of magazine body 12. The body portion 28 has a perforation 30 therethrough which, when the end cap 13 is in place, is coaxial with the magazine body perforations 24 and 25 so that bolt 26 extends therethrough, maintaining the end cap 13 in place. The end cap 13 may be made of metal, but lends itself well to be molded of an appropriate plastic material.

The rail 14 is best shown in FIGS. 8 through 10. As viewed in these Figures, the rail 14 has a longitudinal body 31 of uniform thickness surmounted by a longitudinally extending head or cap portion 32 providing the top surface 33 of rail 14. The body 31 has three opposed pairs of laterally extending ribs 34–35, 36–37 and 38–39. It will be noted that the pair of ribs 36–37 are rounded on their underside as at **36*a* and 37*a***. The purpose of this will be apparent hereinafter.

The ribs 34–35, 36–37 and 38–39 extend substantially the length of rail 14 and serve two purposes. First of all, they strengthen the rail. Secondly, they help support a row of staples mounted on rail 14. In FIG. 10, the last staple **40*a* of a row or stick of staples 40 is shown mounted on rail 14. The staple 40*a* straddles rail 14 with its crown portion 40*b* supported on the rail top surface 33 and its legs 40*c* and 40*d*, depending downwardly alongside rail 14. As configured, rail 14 is adapted to support staples of the same width, but of three different leg lengths. Staple 40*a*, as illustrated, is of an intermediate length. It will be noted that its legs 40*c* and 40*d* extend slightly below the rib pair 36–37. A short leg length staple will have legs extending slightly below rib pair 34–35 and a long leg length staple will have its legs extending just below rib pair 38–39. It will be apparent from FIG. 9 that ribs 34 and 36 terminate just short of the forward edge of rail 14. This is also true of ribs 35 and 37**.

Returning to FIG. 2, it will be noted that guide body 10 has a pair of vertical, rearwardly extending walls 41 and 42, notched as at **41*a* and 42*a*, respectively, and a horizontal wall 43. When the magazine 12 is assembled and affixed to guide body 10, the forward end of magazine body 12 slips between horizontal wall 43 and the bottom ends of vertical walls 41 and 42. The forward end of rail 14 is received between and supported by guide body walls 41 and 42. The forward end of cap 32 of rail 14 rests upon the upper ends of walls 41 and 42. The short ribs 34–35 and 36–37 abut the walls 41 and 42. The ribs 38 and 39 are received within wall notches 41*a* and 42*a*. The bottom edge of rail 14 rests upon the bottom inside surface of magazine body 12**.

As shown in FIG. 9, the rearward end of rail 14 is notched, as at 44. Returning again to FIG. 2, the body portion 28 of end cap 13 has an upper portion **28*a* with a socket (not shown) formed therein, an intermediate portion 28*b* with perforation 30 formed therein, and a lower portion 28*c* having a socket (not shown) formed therein. The socket in upper portion 28*a* is adapted to receive a resilient pad 45. Similarly, the socket in lower end cap body portion 28*c* is adapted to receive a resilient pad 46. When the end cap 13 is mounted in place within magazine body 12, that rear end portion of rail 14 above notch 44 is received within the socket in the upper end cap body portion 28 and that rear end portion of rail 14 below notch 44 is received within the socket in the lower end cap body portion 28***c*. Thus, the rail 14 is fully supported by the walls 41, 42 and 43 of guide body 10, by the lower inside surface of magazine body 12, and by the sockets in body portions 28*a* and 28*c* of end cap 13. It will be evident that notch 44 accommodates the body portion 28*b* of end cap 13, making room for perforation 30 therein and the bolt 26 (FIG. 1) joining magazine body 12, end cap 13 and the lower rear body extension 5*a* of tool 1.

The feeder shoe 15 is best seen in FIGS. 3 through 7. The feeder shoe 15 has an inverted U-shaped body 47 comprising an upper base portion 48 and downwardly depending legs 49 and 50. The base portion 48 has a central depressed portion 51 providing an under surface 52 adapted to rest upon and slide along the upper surface 33 of rail 14.

Leg 49 has a rectangular opening 53 from which is formed an inwardly extending arcuate lug 54. The inwardly extending arcuate lug 54 is clearly shown, for example, in FIG. 6. The lug 54 constitutes an integral part of leg 49. The leg 49 also has an opening 55 therein, from which is formed the integral handle 56. The handle 56 has a perforation 57 formed therein. As is shown in FIG. 2, the end of handle 56 may be provided with a cover member 58 of plastic or other suitable material, held in place by means of a rivet 59 (or other appropriate fastener) passing through handle perforation 57. The cover 58 makes handle 56 more comfortable to manipulate.

The feeder shoe leg 50 has an opening 60 equivalent to the opening 53 in leg 49. This enables the formation of integral lug 61. The lug 61 extends inwardly and is of arcuate configuration, being equivalent to lug 54 of leg 49.

To complete the feeder shoe, there is a second opening 62 in leg 50, enabling the formation of integral feeder shoe tab 63. As is most clearly seen in FIG. 3, the tab 63 has an arcuate peripheral edge with a notch 64 formed centrally therein. The purpose of tab 63 and its notch 64 will be explained hereinafter.

As will be evident from FIGS. 2 and 11, the feeder shoe 15 is so sized as to straddle rail 14 with the under surface 52 (see FIG. 4) of its base portion 48 riding along the top surface 33 of rail head 32 and its legs 49 and 50 depending along side rail 14. The arcuate lugs 54 and 61 of feeder shoe 15 extend beneath the curved under sides 36*a* and 37*a* of rail ribs 36 and 37. The feeder shoe 15 may be mounted on rail 14 from either end and is slidable thereon. Once rail 14 is mounted within magazine body 12 between guide body 10 and end cap 13, the feeder shoe lugs 54 and 61 render the feeder shoe captive on the rail. It will be noted from FIG. 11 that the feeder shoe handle 56 extends above and beyond the adjacent side of magazine body 12. FIG. 12 is similar to FIG. 11 and clearly illustrates that feeder shoe 15 can be reversed on rail 14, i.e. mounted on rail 14 with its handle 56 extending to the right of the rail as viewed in FIG. 12, rather than to the left of the rail as viewed in FIG. 11. Thus, feeder shoe 15 can be mounted on rail 14 with handle 56 in positions wherein its handle 56 can be readily grasped by the right hand of the operator, or by the left hand of the operator.

As is evident from FIGS. 1 and 2, the feeder shoe is located on rail 14 behind the stick of staples 40. The function of the feeder shoe 15 is to constantly urge the stick of staples 40 forwardly on rail 14 so that the forwardmost staple of the stick is located within the drive track (not shown) of the tool guide body 10. The forward urging of the feeder shoe 15 can be accomplished in any appropriate manner, including the use of a spring member or other resilient means.

In FIGS. 1 and 2, the means for constantly urging the feeder shoe 15 forwardly on rail 14 is illustrated as comprising an elastomeric cord 65. One end of cord 65 is anchored at the rearward end of magazine 11. While this can be accomplished in any appropriate way, a simple expedient is simply to cause the cord 65 to pass through an opening in end cap 13, whereupon the cord is knotted as at 66 (see FIG. 2).

The cord 65 passes about a freely rotatable pulley at the forward end of magazine body 12. Such a pulley is shown in FIGS. 1 and 2 at 67, rotatively mounted on an internally threaded hub 68. A screw 69, provided with a lock washer 70, passes through a perforation 71 in the side of magazine housing 12 and into threaded engagement with pulley hub 68. The free end of elastomeric cord 65 has an elongated hook 72 crimped or otherwise appropriately affixed thereto. As is evident from FIG. 1, the hook 72 and cord 65 pass behind feeder shoe leg 49 and in front of feeder shoe leg lug 54, engaging feeder shoe leg 49. As a result of this arrangement, the elastomeric cord 65 constantly urges feeder shoe 15 (and the stick of staples 40) forwardly along rail 14, toward tool guide body 10.

When feeder shoe 15 is mounted on rail 14 in the manner shown in FIG. 12, the hook 72 of elastomeric cord 65 can engage feeder shoe leg 50 in the same manner. Alternatively, the magazine body 12 may be provided with a perforation (not shown) coaxial with and equivalent to the perforation 71 in the opposite wall of magazine body 12. Thus, the pulley 67 and its hub 68 could be mounted on the opposite wall of magazine body 12, so that when feeder shoe 15 is mounted in the manner illustrated in FIG. 12, the hook 72 of elastomeric cord 65 can engage feeder shoe leg 49.

The magazine 11 is completed by the provision of door 16. In the embodiment illustrated, the door 16 is shown as being formed of rod stock. The door 16 has an elongated rectilinear portion 73 of a length equal to the majority of the length of rail 14, as can readily be seen in FIGS. 1 and 2. At its rearward end, as viewed in FIG. 2, the rectilinear portion 73 terminates in a laterally extending portion 74 which, in turn, leads to a downwardly depending portion 75. The downwardly depending portion 75 terminates in a laterally extending portion 76, parallel to the portion 74. The portion 76 leads to a portion 77 parallel to the rectilinear portion 73. The portion 77 terminates in a lateral portion 78, equivalent to portion 76. The portion 78 terminates in a portion 79 which is vertical and equivalent to the portion 75. Finally, the portion 79 ends in a lateral portion 80 which extends transversely of the magazine and slopes slightly upwardly, as can best be seen in FIG. 11. The portion 80 constitutes a release arm, as will be apparent hereinafter. It may be provided with a sheath 81 of plastic, rubber or other appropriate material, rendering it more easily and comfortably actuable by the finger of the operator.

The end structure of door 16, at the opposite or forward end of the elongated rectilinear portion 73, is a mirror image of the end portion just described. Thus, at the left hand end of elongated rectilinear portion 73 (as viewed in FIGS. 1 and 2), there are portions 82 through 88, constituting the full equivalent of portions 74 through 80, respectively.

In FIGS. 1, 2 and 11, the tool 1 and/or its parts are shown for set-up as a left hand loading tool. Under these circumstances, the portions 86, 87 and 88 of door 16 are not needed and are cut or severed from the door and discarded. As a result of this, portions 86, 87 and 88 are illustrated in broken lines in FIG. 2.

The magazine assembly is completed by the provision of first and second spring members. The first spring member is indicated at 89 in FIG. 2. Spring member 89 is made of resilient spring metal and comprises a plate-like portion 90 having a pair of perforations 91 and 92 therein. One end of the portion 90 has an inwardly and longitudinally extending resilient tine 93 terminating in a hook-like configuration 94. The spring member 89 is affixed to the inside surface of the right side of magazine body 12. To this end, the magazine body 12 is provided with perforations 95 and 96, coaxial with spring member perforations 91 and 92. A pair of screws 97 and 98 pass through the spring member perforations 91 and 92 and the magazine housing perforations 95 and 96 and are engaged by nuts 99 and 100, respectively. The opposite or left side of magazine housing 12 is provided with a pair of perforations 101 and 102, equivalent to and coaxial with perforations 95 and 96, for use when the door is to be mounted for right hand loading, as will be described hereinafter.

The second spring member is shown at 103. It comprises an elongated plate-like member of resilient spring metal having a pair of inwardly and longitudinally extending tines 104 terminating in hook-like portions 105 and an inwardly and downwardly extending tine 106. At its forward end, spring member 103 is provided with a perforation 107, and the adjacent side of magazine body 12 is provided with a corresponding perforation 108, enabling the spring member 103 to be affixed to the magazine body 12 by screw 109 and nut 110. At its rearward end, the spring member 103 is provided with a perforation 111 which is coaxial with perforations 25 of the magazine body 12. Thus, the spring member 103 is also held in place by the bolt 26 and nut 27 (see FIG. 1). The opposite or left side of the magazine body 12 is provided with a perforation 112, equivalent to perforation 108, and used when the door is to be mounted for right hand loading, to be described hereinafter.

When the door 16 is installed, its portion 85 is located in a notch 113 in guide body 10. This engagement constitutes one hinge point for the door 16. At the other end of door 16, the portion 77 thereof is engaged beneath the inwardly and downwardly extending resilient tine 106 of spring member 103 (see FIG. 11), and this engagement constitutes the other hinge point of door 16. When so mounted, the hook-like portion 94 of the resilient tine 93 of spring member 89 engages door portion 83 at the forward end of the door. At the rearward end of the door 16, the hook-like portion 105 of one of resilient tines 104 of spring member 103 engages door portion 75. In this manner, tines 93 and 104 constantly urge the door 16 to its closed position. Door 16 is shown in its closed position in FIG. 11 with the elongated, rectilinear door portion 73 overlying feeder shoe 15. Thus, it will be evident that door portion 73 will also overlie the stick of staples 40 located on rail 14 ahead of feeder shoe 15, retaining the stick of staples 40 in place on the rail, regardless of the orientation of tool 1 during use.

The operation of the reversible feeder shoe and door system of the present invention will now be described with respect to FIGS. 1, 2 and 11. It wll be remembered that, in these Figures, the reversible feeder shoe 15 and door 16 have been set-up for left hand loading.

With particular reference to FIGS. 1 and 11, to load the magazine 11 of tool 1, the operator grasps the handle 56 of feeder shoe 15 with his left hand and pulls the feeder shoe rearwardly of magazine 11 along rail 14. As feeder shoe 15 approaches the rearward end of magazine 11, the arcuate peripheral surface of feeder shoe tab 63 (see FIG. 3) will engage door portion 75 (see FIG. 2) and will cam the door to its open position. When the feeder shoe 15 is fully retracted on rail 14, the notch 64 of tab 63 (see FIG. 3) will engage door portion 75 (see FIG. 2), and this engagement will serve two purposes. First of all, it will lock the feeder shoe in its rearwardmost position. At the same time, however, it will lock door 16 in its open position.

When door 16 is pivoted to its open position, it will pivot in a clockwise direction (as viewed in FIG. 11), and the elongated, rectilinear door portion 73 will clear and no longer overlie the head portion 32 of rail 14. As a result, a stick of staples 40 can be inserted from the left hand side of of tool 1 inwardly and downwardly into position on rail 14. Once a stick of staples has been located on rail 14, the operator applies a slight lifting force to the release arm portion 80 of door 16. This will remove door portion 75 from the notch 64 in the feeder shoe tab 63 and the feeder shoe will shift forwardly along rail 14 under the urging of elastomeric cord 65 until the forwardmost staple of the stick has entered the drive track (not shown) of guide body 10. The feeder shoe 15 having shifted forwardly, the door is now free to be returned to its staple-retaining, door-closed position shown in FIG. 11, under the urgings of resilient tines 93 and 104. The tool 1 may then be used by the operator until all of the staples of the stick 40 have been drive, whereupon the quick and easy reloading procedure is repeated.

To initially set-up tool 1 for right loading, it is only necessary to follow a few simple steps. The feeder shoe 15 is reversed in position on rail 14 so that its handle 56 extends to the right of the tool. The elastomeric cord 65 is attached to the feeder shoe by means of its hook 72, in the manner described above. If desired, the pulley 67 may be mounted on the right side of magazine body 12. The first spring member 89 is mounted on the left side of magazine body 12, utilizing perforations 101 and 102 in the magazine body.

The door 16, for right hand loading, will be hingedly affixed to the left side of the magazine body 12. Under these circumstances, the door portions 86, 87 and 88 will be left intact, and the door portions 78, 79 and 80 will be removed from the door and discarded. The sleeve 81 is mounted on door portion 88. The door is mounted to the left side of the magazine body 12 in precisely the same manner as described with respect to FIGS. 1, 2 and 11. In this instance, the now forward portion 77 of door 16 will be received within the notch 114 of guide body 10. The notch 114 is equivalent to and lies directly opposite the guide body notch 113.

The staple loading procedure for right hand loading will be substantially identical to that described with respect to left hand loading, differing only in that the feeder shoe handle 56 and the door release arm 88 will be manipulated by the operator's right hand. Similarly, the stick of staples will be inserted inwardly and downwardly from the right of the tool.

Modifications may be made in the invention without departing from the spirit of it. For example, the door 16, in the exemplary embodiment, has been illustrated as being made of rod stock. It would be within the scope of the present invention to provide a sheet metal door or the equivalent molded of appropriate plastic, or the like.

Finally, it would also be within the scope of the present invention to eliminate the magazine body 12. Under these circumstances, the door 16 would have to be hinged to the bottom of rail 14 or to appropriate parts of body 2 of tool 1. The pulley 67 could be appropriately mounted on rail 14, so as to provide clearance for feeder shoe 15. Alternatively, some other form of resilient means could be used to urge the feeder shoe forwardly.

What is claimed is:

1. A magazine for use with a staple driving tool comprising a reversible feeder shoe and door system enabling set-up of said tool for one of right and left-hand loading, said tool being of the type having a body, a driver, a guide body having a drive track for said driver and a magazine, said magazine being of the top-side loading type and comprising a rail terminating at its forward end at said guide body, a row of staples slidably mounted in straddling fashion on said rail, a feeder shoe slidably mounted on said rail behind said row of staples, means to constantly urge said feeder shoe forwardly so that the forwardmost staple of the row is located in said drive track and a door swingable between an open position and a closed position overlying said rail to prevent inadvertent dislodgement of said staples therefrom, resilient means to bias said door to its closed position, said feeder shoe having a substantially symmetrical inverted U-shaped body having a base portion and downwardly depending sides so sized as to straddle said rail, said feeder shoe having an operating handle extending laterally from one of its sides by which it may be shifted rearwardly to a retracted position on said rail, said shoe being reversibly mountable on said rail such that its operating handle can extend to the left of said rail or to the right of said rail, said door being of reversible configuration and being mountable in parallel-shaped relationship to either side of said rail.

2. The structure claimed in claim 1, including a tab on said feeder shoe extending laterally from that feeder shoe side opposite said side from which said operating handle extends, said tab having a peripheral edge comprising a cam surface so configured as to engage a corresponding surface on said door to cam said door from said closed to said open position as said feeder shoe is shifted to said retracted position and means to releasably latch said door in said open position and said feeder shoe in said retracted position.

3. The structure claimed in claim 1, including at least one pair of opposed ribs on said rail extending longitudinally thereof, each of said feeder shoe legs having an arcuate lug thereon extending toward said rail and located each beneath one of said ribs to render said feeder shoe captive on said rail.

4. The structure claimed in claim 1, including an elongated magazine housing of U-shaped cross-section, said housing having a forward end affixed to said guide body and a rearward end affixed to said tool body, an end cap closing the rearward end of said magazine body, said rail being located within said magazine body and extending between and supported by said guide body and said end cap, said door being mountable to either side of said magazine body.

5. The structure claimed in claim 1, wherein said door is made of rod stock and comprises an elongated rectilinear portion adapted to overlie the majority of said rail when said door is in said closed position, said elongated portion terminating at each end in a downwardly depending U-shaped portion which, in turn, terminates in a release arm, depending upon to which side of said rail said door is mounted, the release arm at the door end nearest said guide body is removed from said door and discarded.

6. The structure claimed in claim 2, including an elongated magazine housing of U-shaped cross-section, said housing having a forward end affixed to said guide body and a rearward end affixed to said tool body, an end cap closing the rearward end of said magazine body, said rail being located within said magazine body and extending between and supported by said guide body and said end cap, said door being mountable to either side of said magazine body.

7. The structure claimed in claim 5, including a tab on said feeder shoe extending laterally from that feeder shoe side opposite said side from which said operating handle extends, said tab having a peripheral edge comprising a cam surface so configured as to engage the adjacent leg of said U-shaped portion at the rearward end of said door to cam said door from said closed to said open position as said feeder shoe is shifted to said retracted position, said peripheral tab edge having a notch formed therein to receive said adjacent leg of said last mentioned U-shaped portion of said door to releasably latch said door in said open position and said feeder shoe in said retracted position.

8. The structure claimed in claim 7, including an elongated magazine housing of U-shaped cross-section, said housing having a forward end affixed to said guide body and a rearward end affixed to said tool body, an end cap closing the rearward end of said magazine body, said rail being located within said magazine body and extending between and supported by said guide body and said end cap, said door being mountable to either side of said magazine body.

* * * * *